United States Patent [19]

MacLeod et al.

[11] Patent Number: 5,060,431

[45] **Date of Patent: * Oct. 29, 1991**

[54] RIDGE ROOF VENT

[75] Inventors: Richard J. MacLeod, Milford; Norman L. Chubb, Dearborn; Charles E. Schiedegger, Metamora, all of Mich.

[73] Assignee: Tapco Products Company Inc., Detroit, Mich.

[ * ] Notice: The portion of the term of this patent subsequent to May 15, 2007 has been disclaimed.

[21] Appl. No.: 598,246

[22] Filed: Oct. 16, 1990

[51] Int. Cl.[5] ..... F24F 7/02

[52] U.S. Cl. ..... 52/199; 52/105; 98/42.21; 98/42.22; 98/121.1

[58] Field of Search ..... 52/105, 199

[56] References Cited

U.S. PATENT DOCUMENTS 4,870,788 10/1989 Hassan ..... 52/105

4,924,761 5/1990 MacLeod et al. ..... 52/199

*Primary Examiner*—Richard E. Chilcot, Jr.

*Assistant Examiner*—Kien T. Nguyen

*Attorney, Agent, or Firm*—Barnes, Kisselle, Raisch, Choate, Whittemore & Hulbert

[57] ABSTRACT

A ridge roof vent adapted to be mounted on the ridge of a roof and comprising a top wall that is spaced from the remainder of the vent and is adapted to receive overlapping pieces of shingle roofing material comprising transversely extending primary indicia provided along the length of the ridge roof vent and including secondary transverse indicia associated with the transverse primary indicia in repetitive series. Each series of transverse primary indicia spans a distance less than the length of a shingle piece. The transverse primary indicia associated with the secondary indicia are positioned such that when a first shingle piece is applied from one end, the end of the shingle piece will be positioned between a pair of equally spaced secondary indicia and can be used to provide an overlap of the ends of the shingle pieces without the need for measurement. The ridge roof vent further includes a longitudinally extending line defining the center of the ridge vent and the transverse primary indicia intersects the line. The ridge roof vent further includes longitudinally extending indicia corresponding to dimensional increments such that they serve as a guide for cutting the vent where the roof is such that a equal number of ridge vents cannot be used and a ridge vent needs to be cut.

5 Claims, 4 Drawing Sheets

RIDGE ROOF VENT

This invention relates to ridge roof vents and particularly to ridge roof vents wherein pieces of shingle roofing are applied to the top wall to simulate the remainder of the roof.

BACKGROUND AND SUMMARY OF THE INVENTION

In ridge roof vents it is conventional to provide a top wall that is spaced from the ridge of the roof so that the interior of the building may be vented. When pieces cut from a shingle are applied on the top wall of the ridge roof vent, they are overlapped. Problems occur with respect to obtaining the desired equal overlap of the shingle pieces and orienting of the shingles so that their edges are a right angle to the longitudinal axis of the roof vent. A further problem arises when a roof vent needs to be cut because the number of roof vents do not correspond to the length of the roof.

Accordingly, among the objectives of the present invention are to provide a ridge roof vent that includes indicia that will provide the desire to overlap; which will facilitate alignment of the shingle pieces; and which can be used as guides for cutting a length of ridge roof vent.

In accordance with the invention, a ridge roof vent adapted to be mounted on the ridge of a roof comprises a top wall that is spaced from the remainder of the vent and is adapted to receive overlapping pieces of shingle roofing material comprising transversely extending primary indicia provided along the length of the ridge roof vent and includes secondary transverse indicia associated with the transverse primary indicia in repetitive series. Each series of transverse indicia spans a distance less than the length of a shingle piece. The transverse primary indicia associated with the secondary indicia are positioned such that when a first shingle piece is applied from one end, the end of the shingle piece will be positioned between a pair of equally spaced indicia and can be used to provide an overlap of the ends of the shingle pieces without the need for measurement. The ridge roof vent further includes a longitudinally extending line defining the center of the ridge vent and the transverse primary indicia intersects the line. The ridge roof vent further includes longitudinally extending indicia corresponding to dimensional increments such that they serve as a guide for cutting the vent where the roof is such that a equal number of ridge vents cannot be used and ridge vent needs to be cut.

DESCRIPTION

Figure 1:
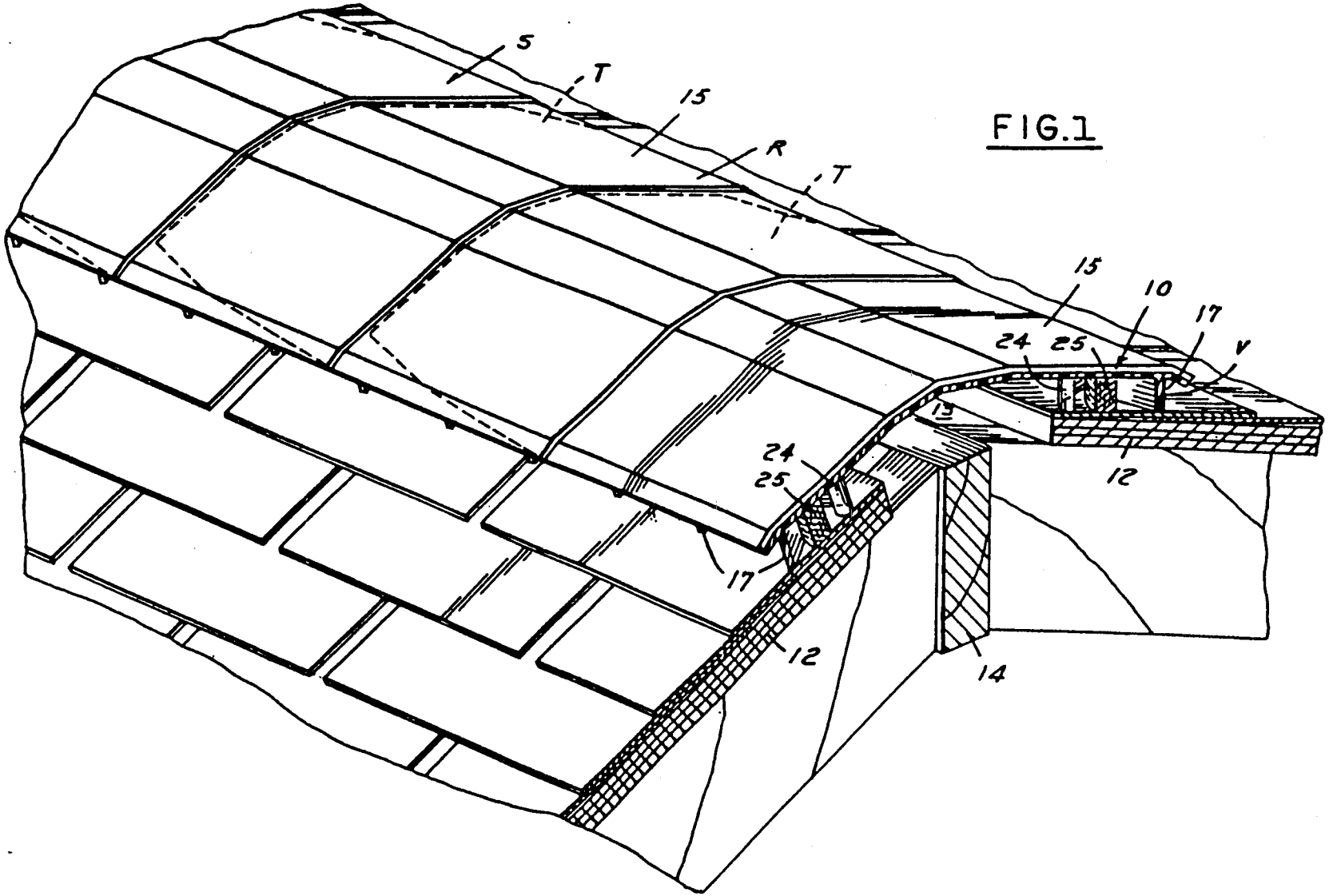
FIG. 1 is a perspective view of a roof embodying the invention.

Referring to FIG. 1, the roof vent 10 embodying the invention is adapted to be mounted on the ridge of a roof by nails 11 extending into the roof in order that the interior of the building may be vented. In accordance with well known construction, portions of the roof walls 12 are cut away as at 13 adjacent the ridge board 14 and the vent 10 is positioned over the shingles on the roof walls 12 and over the opening 13. Subsequently, sections or pieces of roofing shingle material 15 are provided over the vent in overlapping relation, if desired over the roof vent.

Figure 4:
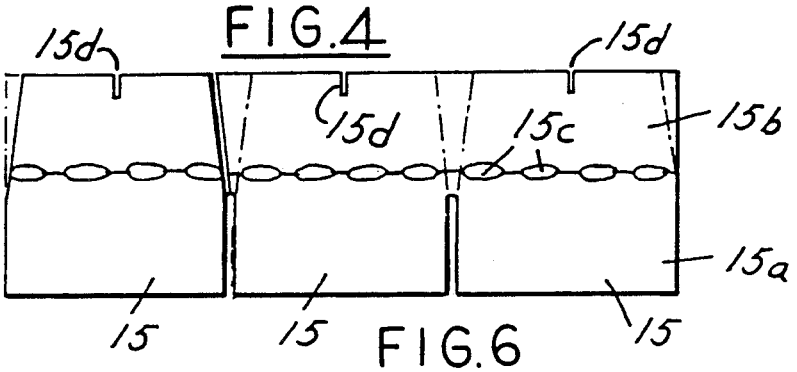
FIG. 4 is a top plan view of a conventional shingle showing the manner it is cut to provide a shingle piece.
Figure 6:
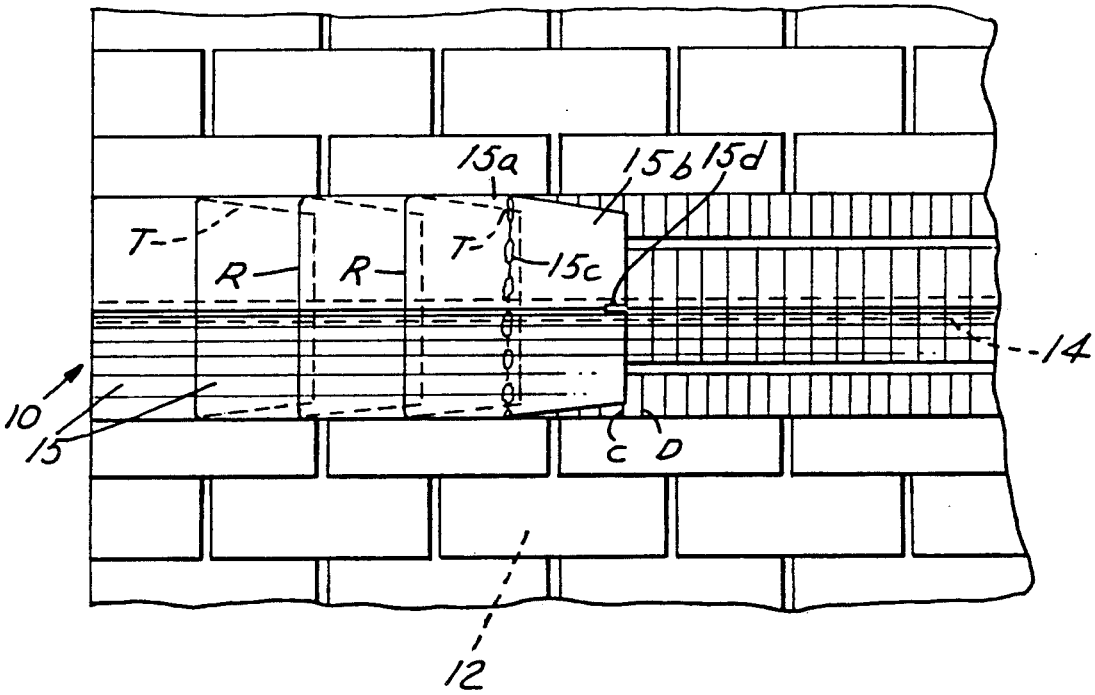
FIG. 6 is a fragmentary plan view showing a roof and a roof vent having a plurality of shingle pieces applied thereto.
Figure 5:
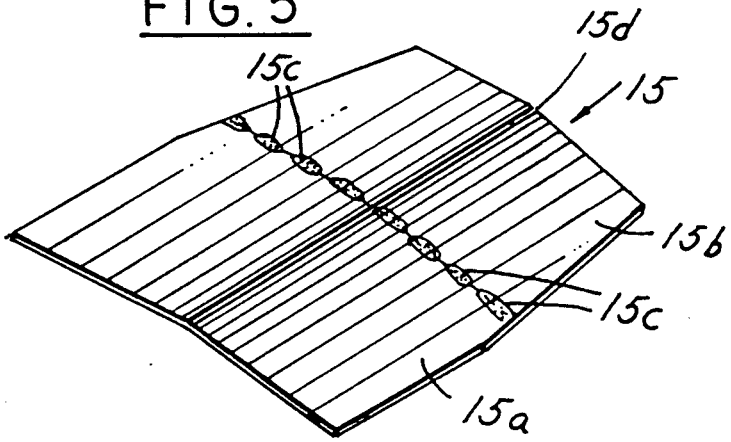
FIG. 5 is a perspective view showing a typical shingle piece.

As shown in FIG. 4, the sections 15 are cut from a conventional shingle along the broken lines which extend to the conventional slits 15*a* in the shingle. The shingle has a portion 15*a* which is intended to be exposed and is uniformly coated with granular material and a portion 15*b* which is intended not to be exposed and has granular material less sparsely provided thereon. In addition, the shingle has spaced adhesive areas 15*c* which become activated by heat to adhere overlapping shingles and cooperate with the nails normally used to fasten the shingle.

The aforementioned construction is preferably the type shown in copending application Ser. No. 452,239 filed Dec. 18, 1989 which is continuation-in-part of application Ser. No. 293,946 filed Jan. 5, 1989, now U.S. Pat. No. 4,924,761 both of which are incorporated herein by reference.

Figure 2:
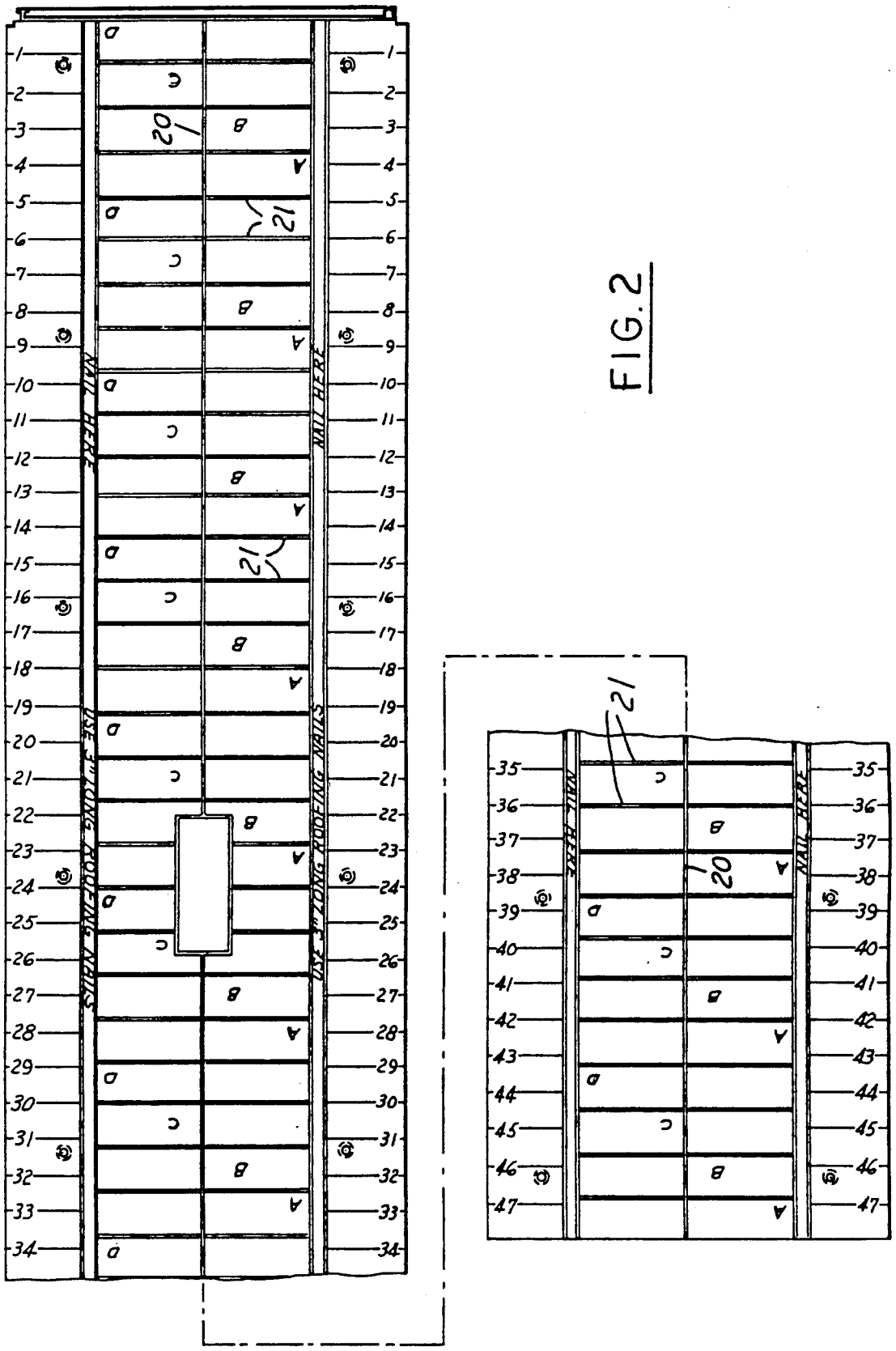
FIG. 2 is a plan view of the ridge roof vent.
Figure 3:
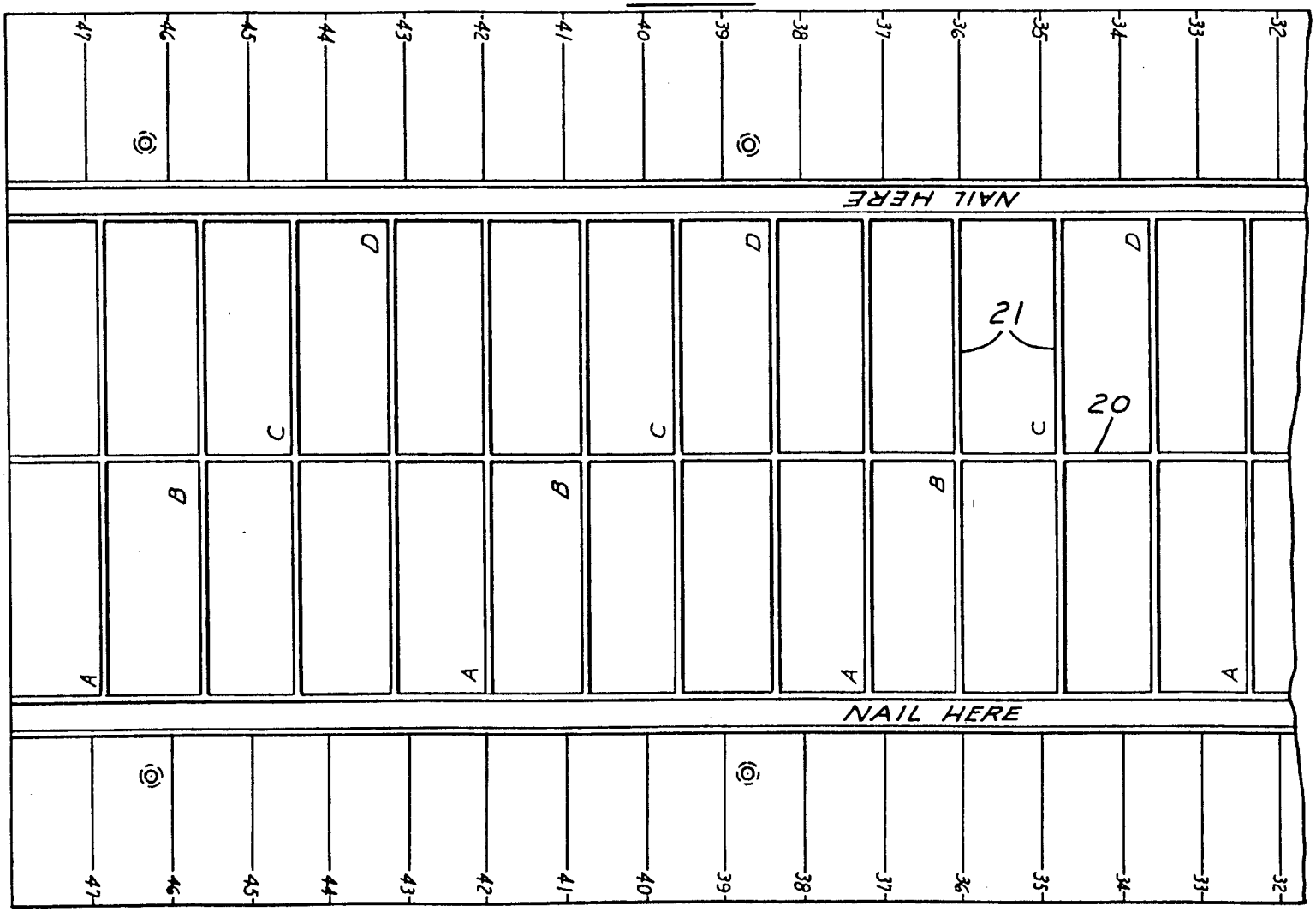
FIG. 3 is a fragmentary enlarged plan view of a portion of the ridge roof vent.

Referring to FIGS. 2 and 3, the ridge roof vent 10 includes indicia on the top wall that are intended to overcome the problems described above. In accordance with the invention, indicia 20 in the form of a longitudinally extending raised line 20 molded in the plastic of the ridge roof vent extends longitudinally along the middle of the vent. Primary indicia in the form of transversely extending equally spaced raised lines 21 are provided in intersecting relation to the line 20. The lines 21 are provided in equally spaced positions relative to one another and are, in turn, provided with repetitive secondary indicia such as letters A, B, C, and D thereby providing a series of lines herein designated by the indicia A, B, C, and D. Each series of lines 21 spans a length greater than the length of the shingle piece 15 to be applied. For example, if the shingle piece is 12 inches in length, the lines spanning a series of indicia A, B, C, D cover 4.80 inches. If the exposed portion 15*a* of the shingle piece has a length, for example, of 5 inches, the next shingle piece is placed to overlap the unexposed portion 15*b* of the first shingle piece by positioning the edge of the portion 15*b* of the next shingle piece 15 between the lines where the edge of the portion 15*b* of the first shingle piece lies, wherein shown as between lines C and D.

In this fashion, when a piece is first placed starting at one end. The slit 15*a* of the shingle piece 15 is aligned with the line 20 to center the piece 15. The lines 21 assist in positioning the piece so that it is at a right angle to the length, namely, the line 20. The free edge of the first shingle piece thus falls at a position in a space between a pair of the indicia A, B, C or D. In applying the second piece, the first end of the second piece is overlapped with a free end of the first piece and the other or free end of the second piece is positioned so that the free edge of the second piece falls in a position between the lines A, B, C and D of the next series of lines and, for example, between lines C and D as did the first piece.

Thus, successive shingle pieces 15 are applied in correct right angle relation and with equivalent overlap.

For example, if the free edge of the first piece lies between indicia C and D, the free end of the second piece is positioned along the line C furthest away.

As further shown in FIGS. 2 and 3, the top surface of the ridge roof vent is provided with longitudinally extending indicia 22 at increments corresponding to the scale of the distances concerned, for example, inches. These serve to provide ready indicia for cutting off a portion of the roof vent when the length of the roof is less than an equal number of roof vents.

It has been found that preferably the lines 20 21 and 22 comprise raised lines molded in the vent if it is made of plastic. In order to discriminate, for example, the height and width of the lines can differ. Thus, the line 20 and lines 21 may have a height of 0.010 inch and a width of 0.030 inch while the lines 22 may have a height of 0.005 inch and a width of 0.010 inch.

It can thus be seen that there has been provided a ridge roof vent that includes indicia that will provide the desire to overlap; which will facilitate alignment of the shingle pieces; and which can be used as guides for cutting a length of ridge roof vent.

We claim:

1. A ridge roof vent adapted to be mounted on the ridge of a roof and comprising a top wall that is spaced from the remainder of the vent and is adapted to receive overlapping shingle pieces of roofing material, the improvement comprising transversely extending primary indicia provided along the length of the ridge roof vent and including secondary indicia associated with the primary indicia in repetitive series, each series of transverse primary indicia spanning a distance greater than the length of a shingle piece, the transverse indicia associated with the secondary indicia being such that when the first shingle piece is applied from one end, the end of the shingle piece will be positioned between a pair of indicia of a series and can be used to provide indicia an overlapping for ends of a succeeding shingle piece by locating the end of the succeeding piece between the secondary indicia of the succeeding series corresponding to the indicia of the preceding series where the first edge of a preceding piece has been positioned without the need for measurement.

2. The ridge roof vent set forth in claim 1 including a longitudinally extending line defining the center of the ridge vent, said primary first indicia intersecting said line.

3. The ridge roof vent set forth in claim 2 including longitudinally extending indicia corresponding to dimensional increments such that they serve as a means for cutting the vent where the roof is such that an equal number of ridge vents cannot be used and one needs to be cut.

4. The ridge roof vent set forth in any one of claims 1-3 wherein said primary indicia comprises lines and said secondary indicia comprises letters.

5. The ridge roof vent set forth in any one of claims 1-3 wherein said primary indicia comprises integral raised lines and said secondary indicia comprises integral raised letters.

* * * * *